United States Patent [19]

Neidorff

[11] 4,313,082

[45] Jan. 26, 1982

[54] POSITIVE TEMPERATURE COEFFICIENT CURRENT SOURCE AND APPLICATIONS

[75] Inventor: Robert A. Neidorff, Chandler, Ariz.

[73] Assignee: Motorola, Inc., Schaumburg, Ill.

[21] Appl. No.: 164,625

[22] Filed: Jun. 30, 1980

[51] Int. Cl.[3] ..... G05F 3/20

[52] U.S. Cl. ..... 323/312; 307/310; 323/907; 330/266; 330/267

[58] Field of Search ..... 323/312-317, 323/226, 311, 907; 330/226, 267, 296; 73/362 SC; 307/310

[56] References Cited

U.S. PATENT DOCUMENTS

| | | | |
|---|---|---|---|
| 3,619,798 | 11/1971 | Smith et al. | 330/296 |
| 3,809,929 | 5/1974 | Vittoz | 73/362 SC |
| 4,004,462 | 1/1977 | Dobkin | 323/226 |
| 4,262,244 | 4/1981 | Price | 323/316 |

FOREIGN PATENT DOCUMENTS

| | | | |
|---|---|---|---|
| 634449 | 11/1978 | U.S.S.R. | 330/266 |

OTHER PUBLICATIONS

Electronics, "Integrated Temperature Transducers", pp. 130, 131, Nov. 1974.

Elektor (English), vol. 2, No. 7-8, p. 746, Jul.-Aug. 1976.

*Primary Examiner*—William H. Beha, Jr.

*Attorney, Agent, or Firm*—Michael D. Bingham

[57] ABSTRACT

A circuit for providing a current having a positive temperature coefficient including a first circuit for producing a first current having substantially a constant temperature coefficient (or a negative temperature coefficient) of a first predetermined value. The first current source is coupled to a current sink circuit which sinks a known value of current from said first circuit, the current sunk by the current sink circuit having a negative temperature coefficient of a second predetermined value. The negative temperature coefficient current of the current sink circuit being greater than the negative temperature coefficient of the current source so that a difference current is provided having a positive temperature coefficient.

15 Claims, 4 Drawing Figures

POSITIVE TEMPERATURE COEFFICIENT CURRENT SOURCE AND APPLICATIONS

BACKGROUND OF THE INVENTION

1. Field of the Invention

This invention relates to a current source for utilization in integrated circuits and, more particularly, to a current source for providing a current, the magnitude of which increases with increasing temperatures.

2. Description of the Prior Art

Current sources having positive temperature coefficients find many applications in integrated circuits. For example, potential applications for current sources having positive temperature coefficient can be found in monolithic operational amplifiers, temperature references, voltage regulators and many other linear integrated circuit applications requiring temperature compensation.

A general method utilized in the prior art to generate a zero temperature coefficient voltage reference uses the negative temperature coefficient of an emitter-base voltage in conjunction with the positive temperature coefficient of an emitter-base voltage differential of two transistors operating at different current densities to make a zero temperature coefficient reference. The aforedescribed circuit is generally known in the art as a band gap regulator.

For another prior art application, using similar techniques as discussed above, a current source having a particular temperature coefficient is used in a class AB operational amplifier stage of a monolithic circuit for setting the idling current through the complementary transistor output pair to a constant value. The foregoing technique is utilized in the MC4558 operational amplifier manufactured by Motorola Inc. for instance.

Although the particular current source for the MC4558 works quite well, a tight specification must be held with respect to the magnitude of current generated by the current source. Additionally, because this current source operates as a current mirror and includes a pair of PNP transistors with one transistor thereof configured as a diode and having a resistor connected in series with the emitter thereof a tight matching tolerance is required so that the input current is correctly ratioed with respect to the output current.

Thus there is a need for a current source for applications in integrated circuits which has loosened requirements with respect to the components comprising the same and which is generally of less complexity with respect to prior art current sources.

SUMMARY OF THE INVENTION

In view of the above, it is an object of the present invention to provide a current source for utilization in monolithic circuits to provide a current having a positive temperature coefficient.

In accordance with the above, there is provided a current source for providing a current having a positive temperature coefficient which includes a first current producing circuit for sinking current of a known magnitude, said first current source circuit producing a sink current having a predetermined temperature coefficient, a second current source circuit is provided for producing a second current of greater magnitude than said first current, said second current having substantially a constant temperature coefficient (or a temperature coefficient of similar polarity to the first current but of lower magnitude), the first and second current sources are coupled together such that a difference current is provided at a common node therebetween having a magnitude which is the difference between the current sourced by the second current source circuit and the current sunk by the first current source wherein the difference current has a positive coefficient.

In one feature of the invention the current source is used to provide an idling current of the complementary transistor output stage of a Class AB monolithic operational amplifier such that said idling current remains substantially constant over a predetermined temperature range.

DETAILED DISCUSSION OF THE PREFERRED EMBODIMENT

Figure 1:
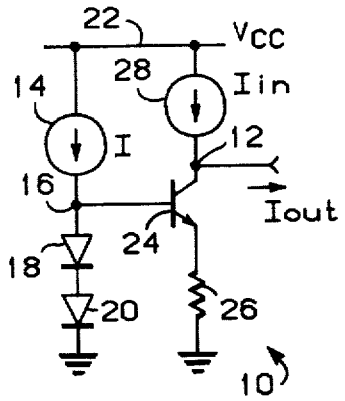
FIG. 1 is a schematic diagram of a circuit useful for explaining the preferred embodiment of the invention.

Turning to FIG. 1 there is shown current source 10 of the preferred embodiment which is useful for explaining the generation of a positive temperature coefficient current, $I_{out}$. Current source 10 comprises a first circuit for sinking a current of predetermined magnitude at node 12. This circuit includes current source 14 connected in series at common node 16 to diodes 18 and 20 between a first power supply conductor 22 and a terminal at which is supplied a ground reference potential. A source of operating potential illustrated as $V_{CC}$ is supplied to conductor 22. NPN transistor 24 is shown having the base connected to node 16, the emitter connected in series with a resistor 26 to the ground reference terminal and the collector connected to output terminal or node 12 at which is provided $I_{out}$. Current source 10 may be fabricated in monolithic integrated circuit form and, as understood, diodes 18 and 20 may be fabricated utilizing NPN transistors matched to transistor 24 wherein the collector electrodes thereof are directly connected to the bases thereof to form said diode. As realized, the current I provided by current source 14 produces a voltage at node 16 which is the magnitude of the voltage developed across each respective diode 18 and 20; being equal to 2 $V_{BE}$ (where $V_{BE}$ is the base-emitter voltage developed across each respective diode). The voltage at node 16 is developed across the series connected base-emitter junction of transistor 24 and resistor 26 such that the collector current through transistor 24 is equal to substantially $V_{BE}$/R26. Since this collector current is a function of a base-emitter voltage the magnitude of the collector current will vary in direct relation to the negative coefficient of temperature of $V_{BE}$, i.e., it has a negative temperature coefficient as known.

A second circuit, current source 28, is provided which is coupled between $V_{CC}$ and node 12 to provide collector current to transistor 24. Assuming that the magnitude of current $I_{in}$ is greater than the collector current conducted by transistor 24, $I_{out}$ is provided at output terminal 12 having a magnitude which is equal to the difference between $I_{in}$ and the collector current of transistor 24. Further, assuming that current $I_{in}$ has either a substantially constant temperature coefficient or a temperature coefficient which is lower than the temperature coefficient of the collector current of transistor 24, the temperature coefficient of $I_{out}$ will be positive.

Figure 2:
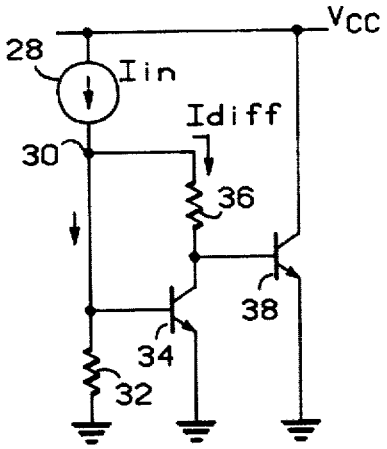
FIG. 2 is a schematic diagram illustrating a particular application of the preferred embodiment.

Turning now to the remaining Figures there is shown typical applications for the positive temperature coefficient current generated by the technique described for the circuit of FIG. 1 and wherein like components are designated by the same reference numerals. In particular, the circuit of FIG. 2 generates a current $I_{diff}$ having a positive temperature coefficient by subtracting from the current provided at node 30 from current source 28 a current produced through resistor 32. The current through resistor 32 is a function of the base-emitter voltage of transistor 34 (which has its base-emitter junction coupled thereacross). As previously described, the resultant difference current, $I_{diff}$, flows through resistor 36 and has a positive temperature coefficient. This difference current produces a voltage drop to be induced that causes the base-emitter voltage across transistor 38 that is less than the base-emitter voltage induced across transistor 34. Thus, because $I_{diff}$ has a positive temperature coefficient, the current through transistor 38 has a substantially constant value over temperature; the positive temperature coefficient of $I_{diff}$ balancing the negative coefficient of the base-emitter voltage of transistor 38. Hence, the current conducted through the collector of transistor 38 is substantially constant with temperature.

Figure 3:
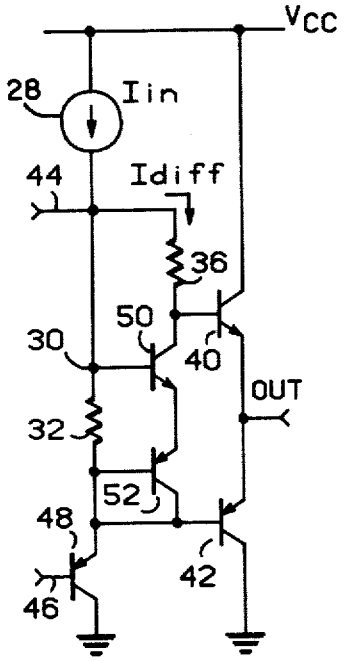
FIG. 3 is a schematic diagram illustrating another application utilizing the circuit of the preferred embodiment.

Turning to FIG. 3, the foregoing technique of providing a positive temperature coefficient current is extended for use in a class AB output stage of an operational amplifier comprising complementary output transistors 40 and 42. Transistors 40 and 42 are driven by preamplifier stages connected to terminals 44 and 46 to directly drive NPN transistor 40 through resistor 36 and to drive output transistor 42 through PNP transistor 48 as is well known in the prior art. In this particular application a voltage having a magnitude equal to 2 $V_{BE}$ is developed across resistor 32 from transistors 50 and 52 which produces a current therethrough that is subtracted from the current $I_{in}$ supplied by current source 28 at node 30 to result in the current $I_{diff}$ having a positive temperature coefficient as previously described. $I_{diff}$ causes an idling current through transistors 40 and 42 when the operational amplifier is operated in class AB mode of operation which has a substantially constant or zero temperature coefficient.

Figure 4:
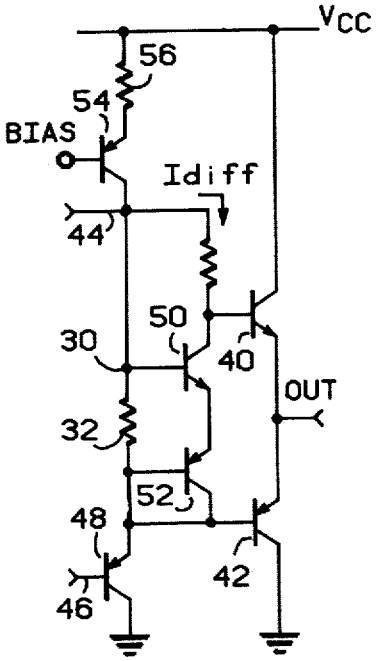
FIG. 4 is a schematic diagram illustrating the circuit of FIG. 3 in more detail.

Turning now to FIG. 4, there is shown the complementary output stage of the operational amplifier of FIG. 3 wherein current source 28 is realized with a simple PNP transistor 54 and resistor 56. The circuit of FIG. 4 can be compared with the aforereferenced MC4558 operational amplifier wherein, by the addition of resistor 32, a constant idle current is achieved through the use of the simple current source comprising transistor 54 and resistor 56 as compared to the more complex current source required in the MC4558.

Thus, what has been described above, is a circuit and applications thereof for providing a positive temperature coefficient current by means of a simple circuit useful for utilization in integrated circuit applications. The current source can be achieved with very loose matching tolerance and requirements placed thereupon. By having reduced tolerance requirements, the current source described above can improve production yields of integrated circuits employing the same to increase manufacturing yields to reduce cost of the integrated circuits.

I claim:

1. A current source for producing a current having a positive temperature coefficient, comprising:

first circuit means for producing a first current having a negative temperature coefficient; and second circuit means for providing a second current independently of said first current having a temperature coefficient different from said first current, said second circuit means being coupled to said first circuit means such that said first current is subtracted from said second current to produce a difference current at a common node between said first and second circuit means having a positive temperature coefficient.

2. The current source of claim 1 wherein said second current has a substantially constant temperature coefficient.

3. The current source of claim 1 wherein said second current has a negative temperature coefficient, said negative temperature coefficient of said second current is less than said negative temperature coefficient of said first current.

4. The current source of claim 2 or 3 wherein said first circuit means includes:

first resistive means having first and second terminals, said first terminal being coupled to said common node; and semiconductor means having a PN junction, said PN junction being coupled across first and second terminals of said first resistive means such that a predetermined voltage is developed across said first resistive means having a negative temperature coefficient whereby said first current is produced through said first resistive means.

5. The current source of claim 4 wherein said semiconductor means includes a first transistor having an emitter, a collector and base, said base and emitter forming said PN junction, said collector being coupled to said common node.

6. The current source of claim 5 wherein said semiconductor means further includes a second transistor of complementary conductivity type of said first transistor and having an emitter, a collector and a base, said emitter being coupled to said emitter of said first transistor, said base and collector being connected to said second terminal of said first resistive means with said base of said first transistor being connected to said first terminal of said first resistive means.

7. The current source of claim 6 including a second resistive means coupled between said collector of said first transistor and said common node.

8. An operational amplifier including the current source of claim 7 having complementary output transistors biased in a class AB mode of operation wherein the base of a first one of said complementary output transistors is connected to said collector of said first transistor and the base of said second one of said complementary transistors is connected with the collector of said second transistor.

9. In a monolithic operational amplifier including a complementary transistor output stage, a current source for providing a driving current having a positive coefficient to produce a substantially constant idling current through the output stage comprising:

first circuit means for producing at an ouput thereof a first current having a first predetermined magnitude which varies in a first manner with temperature;

second circuit means coupled to said output of said first circuit means for sinking a second current having a second predetermined magnitude which varies in a second manner with temperature and with respect to said first current such that the driving current is produced at said output of said first circuit means the magnitude of which is the difference between said first and said second currents and having a positive temperature coefficient.

10. The current source of claim 9 wherein said second circuit means includes:

means for establishing a negative temperature coefficient voltage;

resistive means coupled with said negative temperature coefficient producing means such that a current is produced therethrough having a negative temperature coefficient; and circuit means connecting said resistive means to said first circuit means such that said current produced through said resistive means is subtracted from said first current.

11. The current source of claim 10 wherein said means for establishing a negative temperature coefficient voltage includes:

a first transistor of a first conductivity type having a base, emitter and collector, said base being coupled to a first terminal of said resistive means, said collector being coupled to said first circuit means; and a second transistor of opposite conductivity type than said first transistor and having a base, emitter and collector, said base being coupled to a second terminal of said resistive means, said collector being coupled to the base thereof, and said emitter being connected to said emitter of said first transistor.

12. A current source for producing a current having a positive temperature coefficient, comprising:

first circuit means for producing a first current having a negative temperature coefficient including first resistive means having first and second terminals, said first terminal being coupled to a common node, semiconductor means having a PN junction, said PN junction being coupled across said first and second terminals of said first resistive means such that a predetermined voltage is developed across said first resistive means having a negative temperature coefficient to produce said first current through said first resistive means; and second circuit means for providing a second current having a substantially constant temperature coefficient, said second circuit means being coupled to said first circuit means such that a difference current is produced at said common node which is the difference between said first and second currents having a positive temperature coefficient.

13. The current source of claim 12 wherein said semiconductor means includes a first transistor having an emitter, a collector, and a base, said base and emitter forming said PN junction, said collector being coupled to said common node.

14. The current source of claim 13 wherein said semiconductor means further includes a second transistor of complementary conductivity type to said first transistor and having an emitter, a collector and a base, said emitter being coupled to said emitter of said first transistor, said base and collector being coupled to said second terminal of said first resistive means.

15. The current source of claim 14 including a second resistive means coupled between said collector of said first transistor and said common node.

* * * * *